US007413258B2

(12) United States Patent
Hall et al.

(10) Patent No.: US 7,413,258 B2
(45) Date of Patent: Aug. 19, 2008

(54) HOLLOW PICK SHANK

(76) Inventors: David R. Hall, 2185 S. Larsen Pkwy., Provo, UT (US) 84606; Ronald Crockett, 2185 S. Larsen Pkwy., Provo, UT (US) 84606; Scott Dahlgren, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/871,759

(22) Filed: Oct. 12, 2007

(65) Prior Publication Data

US 2008/0036281 A1 Feb. 14, 2008

Related U.S. Application Data

(63) Continuation of application No. 11/871,722, filed on Oct. 12, 2007, which is a continuation-in-part of application No. 11/844,586, filed on Aug. 24, 2007, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, which is a continuation of application No. 11/742,261, filed on Apr. 30, 2007, which is a continuation-in-part of application No. 11/464,008, filed on Aug. 11, 2006, now Pat. No. 7,338,135, which is a continuation-in-part of application No. 11/463,998, filed on Aug. 11, 2006, which is a continuation-in-part of application No. 11/463,990, filed on Aug. 11, 2006, now Pat. No. 7,320,505, which is a continuation-in-part of application No. 11/463,975, filed on Aug. 11, 2006, which is a continuation-in-part of application No. 11/463,962, filed on Aug. 11, 2006, which is a continuation-in-part of application No. 11/463,953, filed on Aug. 11, 2006, application No. 11/829,761, which is a continuation-in-part of application No. 11/695,672, filed on Apr. 3, 2007, which is a continuation-in-part of application No. 11/686,831, filed on Mar. 15, 2007.

(51) Int. Cl.
*E21C 35/18* (2006.01)

(52) U.S. Cl. ..... 299/111

(58) Field of Classification Search ..... 299/111, 299/81.1, 81.3
See application file for complete search history.

(56) References Cited

U.S. PATENT DOCUMENTS 2,124,438 A 7/1938 Struk (Continued)

*Primary Examiner*—John Kreck
(74) *Attorney, Agent, or Firm*—Tyson J. Wilde

(57) ABSTRACT

In one aspect of the invention, a degradation pick comprises a bolster disposed intermediate a shank and an impact tip. The shank comprises an outer diameter and first and second ends. The shank is coupled to the bolster through the first end and the second end is adapted for insertion into a central bore of a holder attached to a driving mechanism. The shank comprises a hollow portion disposed within the outer diameter and between the first and second ends. The hollow portion may comprise an opening that is disposed in the second end. In some embodiments the hollow portion may comprise a length that is at least as great as the outer diameter.

18 Claims, 10 Drawing Sheets

U.S. PATENT DOCUMENTS 3,254,392 A 6/1966 Novkov
3,830,321 A 8/1974 McKenry
4,098,362 A 7/1978 Bonnice
4,109,737 A 8/1978 Bovenkerk
4,156,329 A 5/1979 Daniels
4,199,035 A 4/1980 Thompson
4,439,250 A 3/1984 Acharya
4,465,221 A 8/1984 Acharya
4,776,862 A 10/1988 Wiand
4,880,154 A 11/1989 Tank
4,932,723 A 6/1990 Mills
4,940,288 A 7/1990 Stiffler
4,951,762 A 8/1990 Lundell
5,112,165 A 5/1992 Hedlund
5,141,289 A 8/1992 Stiffler
5,186,892 A 2/1993 Pope
5,738,415 A * 4/1998 Parrott ..... 299/104
5,738,698 A 4/1998 Kapoor
5,837,071 A 11/1998 Andersson
5,934,542 A 8/1999 Nakamura
5,935,718 A 8/1999 Demo
5,944,129 A 8/1999 Jensen
6,051,079 A * 4/2000 Andersson et al. ..... 299/111
6,065,552 A 5/2000 Scott
6,193,770 B1 2/2001 Sung
6,199,956 B1 3/2001 Kammerer
6,692,083 B2 2/2004 Latham
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin
6,889,890 B2 5/2005 Yamazaki et al.
2002/0175555 A1 11/2002 Mercier
2003/0140350 A1 7/2003 Noro
2003/0234280 A1 12/2003 Cadden
2005/0159840 A1 7/2005 Lin
2005/0173966 A1 8/2005 Mouthaan

* cited by examiner

HOLLOW PICK SHANK

CROSS REFERENCE TO RELATED APPLICATIONS

This application is a continuation of U.S. patent application Ser. No. 11/871,722 which was filed on Oct. 12, 2007, which was a continuation-in-part of U.S. patent application Ser. No. 11/844,586 which was filed on Aug. 24, 2007. U.S. patent application Ser. No. 11/844,586 is a continuation-in-part of U.S. patent application Ser. No. 11/829,761, which was filed on Jul. 27, 2007. U.S. patent application Ser. No. 11/829,761 is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007. U.S. patent application Ser. No. 11/742,304 is a continuation of U.S. patent application Ser. No. 11/742,261 which was filed on Apr. 30, 2007. U.S. patent application Ser. No. 11/742,261 is a continuation-in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006. U.S. patent application Ser. No. 11/463,975 is a continuation-in-part of U.S. patent application Ser. No. 11/463,962 which was filed on Aug. 11, 2006. U.S. patent application Ser. No. 11/463,962 is a continuation-in-part of U.S. patent application Ser. No. 11/463,953, which was also filed on Aug. 11, 2006. The present application is also a continuation-in-part of U.S. patent application Ser. No. 11/695,672 which was filed on Apr. 3, 2007. U.S. patent application Ser. No. 11/695,672 is a continuation-in-part of U.S. patent application Ser. No. 11/686,831 filed on Mar. 15, 2007. All of these applications are herein incorporated by reference for all that they contain.

BACKGROUND OF THE INVENTION

Efficient degradation of materials is important to a variety of industries including the asphalt, mining, construction, drilling, and excavation industries. In the asphalt industry, pavement may be degraded using picks, and in the mining industry, picks may be used to break minerals and rocks. Picks may also be used when excavating large amounts of hard materials. In asphalt milling, a drum supporting an array of picks may rotate such that the picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., U.S. Pat. No. 3,830,321 to McKenry et al., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

The picks typically have a tungsten carbide tip, which may last less than a day in hard milling operations. Consequently, many efforts have been made to extend the life of these picks. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, a degradation pick comprises a bolster disposed intermediate a shank and an impact tip. The shank comprises an outer diameter and first and second ends. The shank is coupled to the bolster through the first end and the second end is adapted for insertion into a central bore of a holder attached to a driving mechanism. The shank comprises a hollow portion disposed within the outer diameter and between the first and second ends. The hollow portion may comprise an opening that is disposed in the second end. In some embodiments the hollow portion may comprise a length that is at least as great as the outer diameter. The outer diameter may be between 0.5 and 2 inches.

The impact tip may comprise an impact surface with a hardness greater than 4000 HK. The impact surface may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

A steel body may be disposed intermediate the first end of the shank and the bolster. The steel body may be brazed to the bolster. The bolster may comprise a cemented metal carbide. In some embodiments the bolster may be a carbide core that is press fit into the steel body. Other embodiments may comprise a first end of the shank that is press fit into the bolster.

A lubricant reservoir may be disposed at least partially within the hollow area. The lubricant reservoir may be pressurized. The lubricant reservoir may comprise a pressurization mechanism selected from the group consisting of springs, coiled springs, foam, closed-cell foam, compressed gas, wave springs, and combinations thereof.

The pick may be part of an asphalt milling machine, a trenching machine, a coal mining machine, or combinations thereof. The second end of the shank may be disposed within a central bore of a holder. The central bore may comprise a closed end proximate a driving mechanism. An o-ring may be disposed proximate a distal surface of the holder and may substantially retain a lubricant within the holder. The o-ring may be disposed intermediate the bolster and the distal surface. In some embodiments the o-ring may be disposed intermediate the shank and an inner surface of the bore.

DETAILED DESCRIPTION OF THE INVENTION AND THE PREFERRED EMBODIMENT

Figure 1:
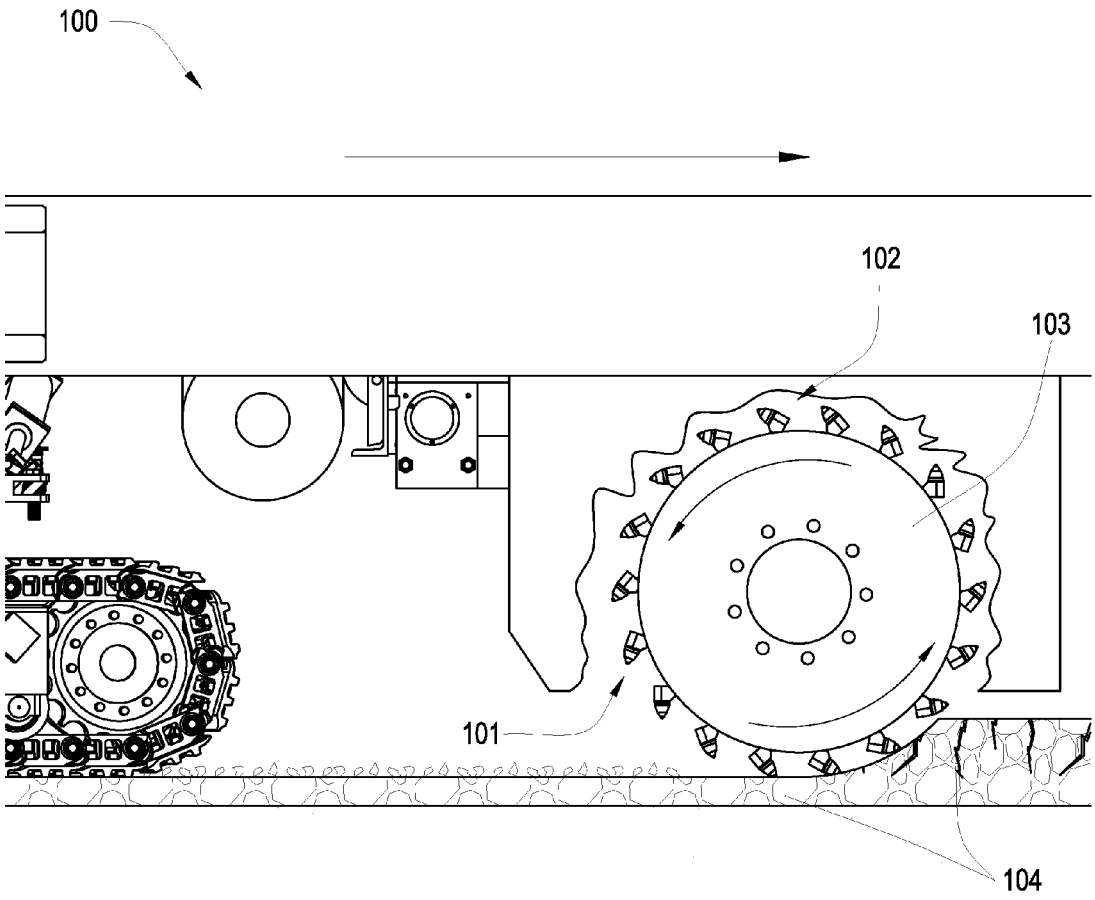
FIG. 1 is a cross-sectional diagram of an embodiment of a recycling machine.

FIG. 1 is a cross-sectional diagram of an embodiment of a plurality of high-impact resistant degradation picks 101 attached to a driving mechanism 103, such as a rotating drum that is connected to the underside of a pavement recycling machine 100. The recycling machine 100 may be a cold planer used to degrade manmade formations such as a paved surface 104 prior to the placement of a new layer of pavement. Picks 101 may be attached to the driving mechanism bringing the picks 101 into engagement with the formation. A holder 102, which may be a block or an extension in the block, is attached to the driving mechanism 103, and the pick 101 is inserted into the holder 102. The holder 102 or block may hold the pick 101 at an angle offset from the direction of rotation, such that the pick 101 engages the pavement at a preferential angle. Each pick 101 may be designed for high-impact resistance and long life while milling the paved surface 104.

Figure 2:
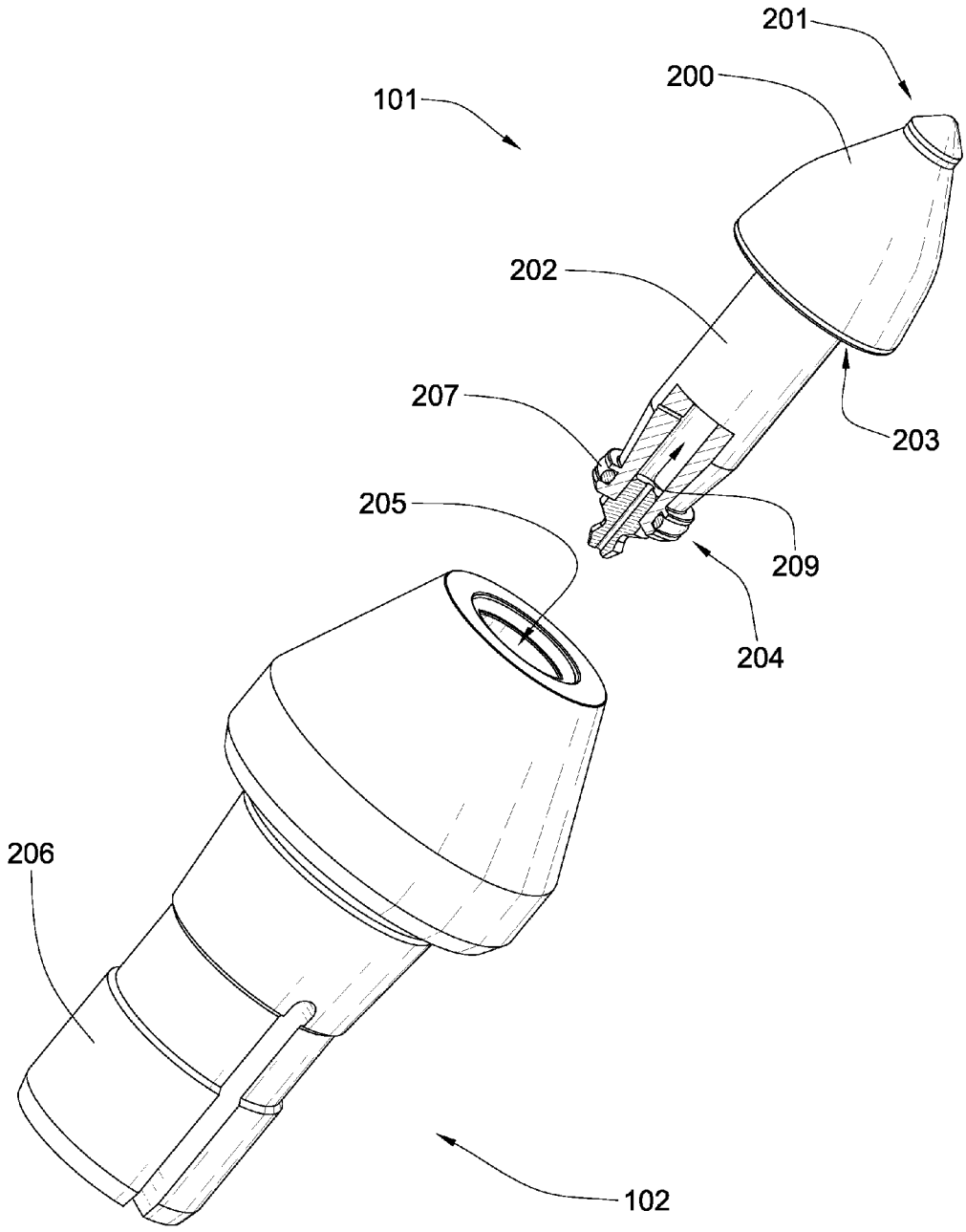
FIG. 2 is an exploded perspective diagram of an embodiment of a high-impact resistant pick and an embodiment of a holder.

Referring now to the embodiment of FIG. 2, the pick 101 comprises a bolster 200 disposed intermediate an impact tip 201 and a shank 202. The shank comprises first and second ends 203, 204. The shank 202 is coupled to the bolster 200 through its first end 203. The second end 204 of the shank is adapted for insertion into a central bore 205 of a holder 102. In the present embodiment the holder 102 is an extension element 206. An o-ring 207 is disposed on the shank 202 proximate the second end 204. Another o-ring 207 may be disposed within the central bore 205 of the extension 206. When the second end 204 of the shank 202 is inserted into the central bore 205, both o-rings 207 may be disposed around the shank 202. A cut-out discloses a hollow portion 209 of the shank 202.

Figure 3:
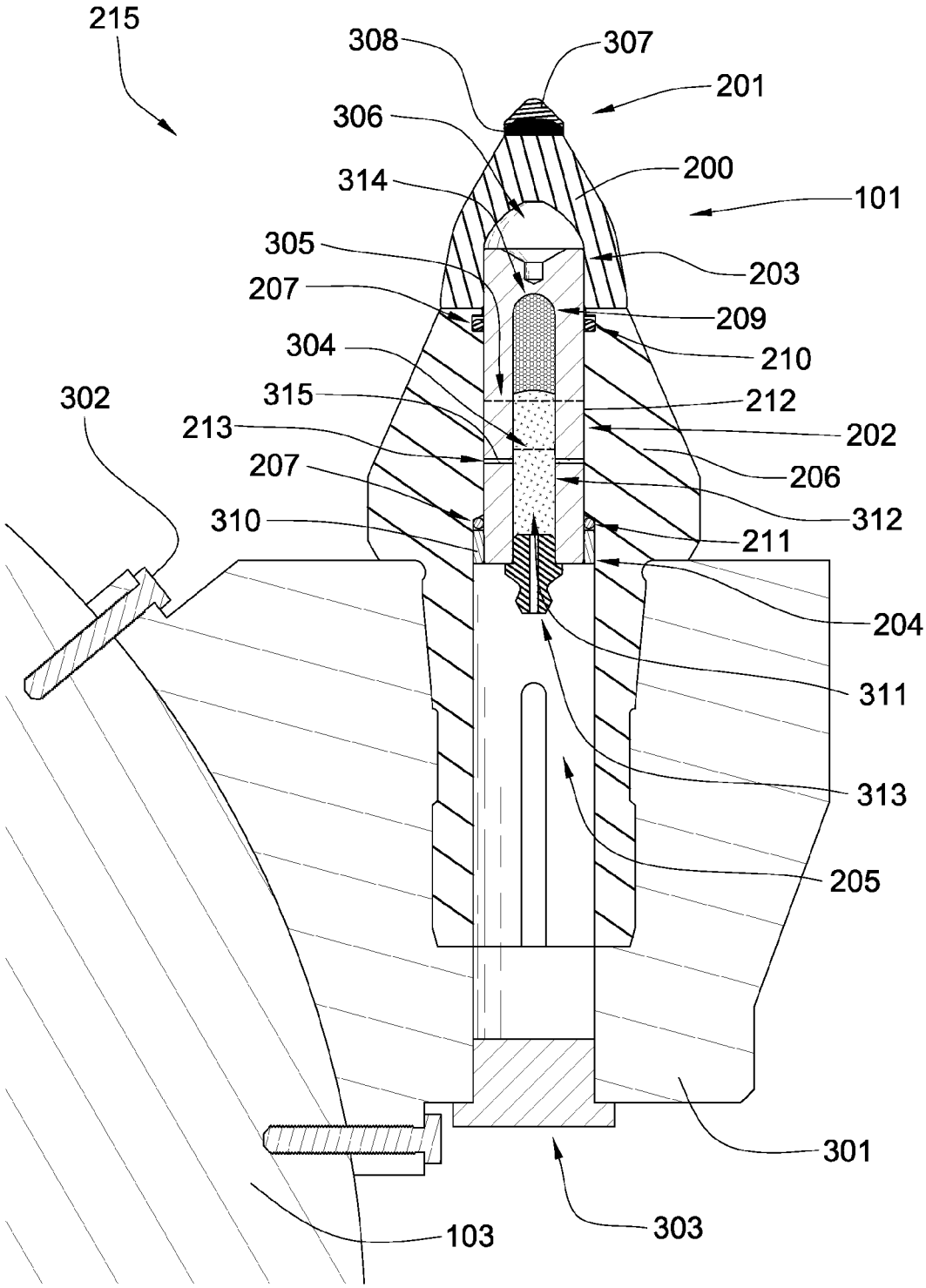
FIG. 3 is a cross-sectional diagram of an embodiment of a high-impact resistant pick.

Referring now to FIG. 3, a cross-sectional diagram discloses an embodiment of a degradation assembly 215 comprising a pick 101 with the second end 204 of the pick shank 202 disposed within the central bore 205 of an extension 206. The extension 206 is disposed within a block 301 that is attached to a degradation drum 103 by a plurality of bolts 302 or welds. In the present embodiment the block 301 and the extension 206 together constitute the holder 102. The block 301 comprises a removable cap 303 proximate the driving mechanism 103. The cap 303 may be press fit into the block 301. The removable cap 303 is an embodiment of a closed end proximate the driving mechanism 103. In some embodiments the closed end may not be removable. In FIG. 3 the shank 202 comprises inner and outer diameters 304, 305. The material of the shank 202 may be disposed intermediate the inner and outer diameters 304, 305. The shank 202 may comprise a hard material such as steel, hardened steel, or other materials of similar hardness. In FIG. 3 the shank 202 comprises a hollow portion 209 within the outer diameter 305 between the first and second ends 203, 204. In the present embodiment the hollow portion 209 is disposed within the inner diameter 304.

In some embodiments the hollow portion 209 may become completely filled or partially filled by one or more materials. In some embodiments the hollow portion 209 may not be filled with any material. In some embodiments the outer diameter may be between 0.5 and 2 inches. The outer diameter may be preferred to be 0.75 inches.

The bolster 200 in FIG. 3 comprises tungsten carbide. The bolster 200 may comprise one or more cemented metal carbides. In some embodiments the bolster 200 may comprise tungsten, titanium, tantalum, molybdenum, niobium, cobalt and/or combinations thereof. The first end 203 of the shank 202 is press fit into a recess 306 in the bolster 200. The impact tip 201 comprises an impact surface 307 with a hardness greater than 4000 HK. The impact surface 307 may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof. In some embodiments the impact surface 307 may be sintered onto a carbide substrate 308. The carbide substrate 308 may be brazed to the bolster 200 with a high-strength braze.

Braze material may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 308 and the impact surface 307. The farther away the impact surface 307 is from the braze interface, the less thermal damage is likely to occur during brazing. Increasing the distance between the brazing interface and the impact surface 307, however, may increase the moment on the carbide substrate 308 and increase stresses at the brazing interface upon impact.

The first end 203 in FIG. 3 may comprise a Morse taper of size 0 to size 7, a Brown taper size 1 to size 18, a Sharpe taper size 1 to 18, an R8 taper, a Jacobs taper size 0 to size 33, a Jamo taper size 2 to 20, a NMTB taper size 25 to 60, or modifications or combinations thereof. In some embodiments, the first end 203 may comprise no taper. The first end 203 may be connected to the bolster 200 by a mechanical fit such as press fits and threads, or by bonds such as a brazes and welds.

The shank 202 may be held in the holder 102 by a retaining ring 310 adapted to fit in an inset portion of the holder 102. The shank 202 may be work-hardened in order to provide resistance to cracking or stress fractures due to forces exerted on the pick 101 by the paved surface 104 or the holder 102. The shank 202 may be work-hardened by shot-peening the shank, chrome plating the shank, enriching the shank with nitrogen and/or carbon or other methods of work-hardening.

The shank may also be rotatably held into the holder 102, such that the pick 101 is allowed to rotate within the holder 102 and so that the pick 101 and holder 102 may wear generally evenly. The first end 203 of the shank 202 may also comprise a recess or grooves to provide compliance to the first end 203. A sleeve may be disposed loosely around the shank 202 and placed within the holder 102, which may allow the sleeve to retain the shank 202 while still allowing the shank 202 to rotate within the holder 102. The shank 202 may comprise a spring adapted to pull down on the shank 202. This may provide the benefit of keeping the pick snugly secured within the central bore 205 of the holder 102.

A lubricant 311 may be inserted into the central bore 205 of the holder 102 so that the lubricant may be disposed intermediate the shank 202 and the holder 102. In the present embodiment a lubricant reservoir 312 is disposed entirely within the hollow portion 209 of the shank 202. The lubricant reservoir may comprise a lubricant selected from the group consisting of grease, petroleum products, vegetable oils, mineral oils, graphite, hydrogenated polyolefins, esters, silicone, fluorocarbons, molybdenum disulfide, and combinations thereof. A filling port 313 is disposed proximate the second end 204 of the shank and allows lubricant 311 to be inserted into the reservoir 312 but may prevent the lubricant 311 from exiting the reservoir 312 through the second end 204 by comprising a check-valve.

In FIG. 3 the lubricant reservoir 312 is pressurized by a pressurization mechanism 314. In the present embodiment the pressurization mechanism 314 is closed-cell foam. When lubricant 311 is added to the reservoir 312, the closed-cell foam may be forced to decrease its volume in order to match the pressure exerted on the foam by the lubricant 311, thereby allowing the lubricant 311 to be inserted. After the lubricant 311 is inserted into the central bore 205, the pressurization mechanism 314 may apply a substantially constant pressure on the lubricant 311. In some embodiments of the invention the lubricant reservoir 312 may comprise a pressurization mechanism 314 selected from the group consisting of springs, coiled springs, foam, closed-cell foam, compressed gas, wave springs, and combinations thereof.

In the present embodiment the lubricant reservoir 312 comprises generally tubular lubricant exit pathways 315 that extend radially outward from the inner diameter 304 to the outer diameter 305. The exit pathways 315 may connect to the central bore 205 at a passage opening 213. The pressure from the pressurization mechanism 314 may force the lubricant 311 through the exit pathways 315 and into a space between the shank 202 and the holder 102. O-rings 207 disposed proximate the first and second ends 203, 204 of the shank may respectively form first and second seals 210, 211. The first and second seals 210, 211 may substantially retain the lubricant 311 between the shank 202 and the holder 102. This may allow the pick 101 to rotate more easily and may decrease friction while the pick 101 rotates. The decreased friction may allow for better wear protection of areas in contact with the holder 102, such as the shank 202 or a base of the bolster 200. An enclosed region 212 may be disposed intermediate the first and second seals 210, 211 and may comprise a volume disposed intermediate the pick 101 and the holder 102. In FIG. 3 the enclosed region 212 is disposed intermediate the holder 102 and the pick shank 202. In the current embodiment the enclosed region is in fluid communication with the pressurized lubricant reservoir 312 via the lubricant exit pathways 315. The lubricant 311 enters the enclosed region 212 though a passage opening 213 disposed intermediate the first and second seals 210, 211. The passage opening 213 connects the enclosed region 212 to the hollow portion 209 of the shank 202 via the lubricant exit pathways 315.

Figure 3A:
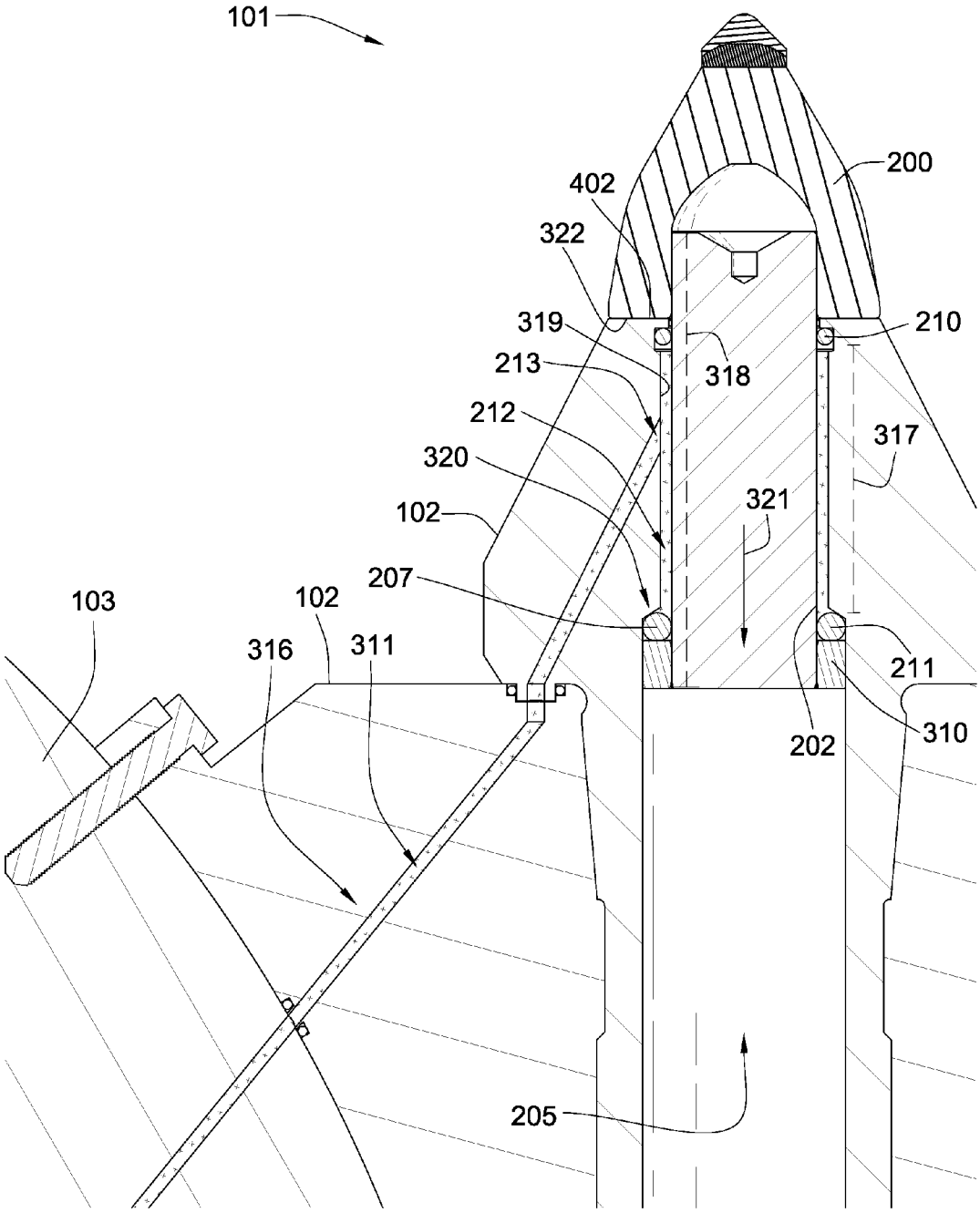
FIG. 3*a* is a cross-sectional diagram of an embodiment of a degradation assembly.

Referring now to FIG. 3*a*, the lubricant 311 may also be provided to the central bore 205 from the driving mechanism 103. In embodiments where the driving mechanism 103 is a drum 103, the drum 103 may comprise a lubricant reservoir 312 and a channel 316 may be formed in the drum 103 which leads from the lubricant reservoir 312 to the holder 102. The lubricant reservoir 312 may be pressurized to force the lubricant 311 through the channel 316 and to the passage opening 213. From the passage opening 213 the lubricant 311 may enter the enclosed region 212 between the shank 202 and the holder 102 that is disposed in part of the central bore 205 of the holder 102. The enclosed region 212 may comprise an enclosed length 317 that may extend from the first seal 210 to the second seal 211. In some embodiments of the invention the enclosed length 317 may be at least one half a total length 318 of the shank 202. The total length 318 of the shank may extend from the first end 203 to the second end 204. At least one of the first and second seals 210, 211 may be a weeping seal. A weeping seal disposed proximate the bolster 200 may provide the benefit of preventing debris from entering the enclosed region 212, while allowing some lubricant 311 to escape to clean the seal.

In FIG. 3*a*, an inside surface 319 of the bore 205 of the holder 102 comprises a tapered edge 320 disposed proximate the second end 204 of the shank 202. A ring 310 is bonded to the second end of the shank 202 proximate the tapered edge 320 and the second seal 211. The ring 310 may be press fit onto the shank 202, or in some embodiments it may be brazed or otherwise bonded to the shank. In FIG. 3*a* the second seal 211 is an o-ring 207 and the o-ring 207 is being compressed by the ring 310 and the tapered edge 320. In some embodiments the second seal 211 may be compressed at least 10% by the ring 310 and the tapered edge 320. The second seal 211 may be compressed by at least 15% by the ring 310 and the tapered edge 320.

When the pressurized lubricant 311 is disposed in the enclosed region 212, the lubricant 311 may exert pressure on the second seal 211 and the ring 310. This pressure may exert a force on the pick 101 represented by an arrow 321. The force may pull a lower surface 322 of the pick 101 towards a distal surface 402 of the holder 102. In some embodiments the pressurized lubricant 311 may maintain substantial contact between the lower surface 322 and the distal surface 402 by maintaining a substantially constant pressure on the ring 310. The force 321 on the pick 101 may retain the pick 101 in the holder 102 while allowing the pick 101 to rotate with respect to the holder 102.

Figure 4:
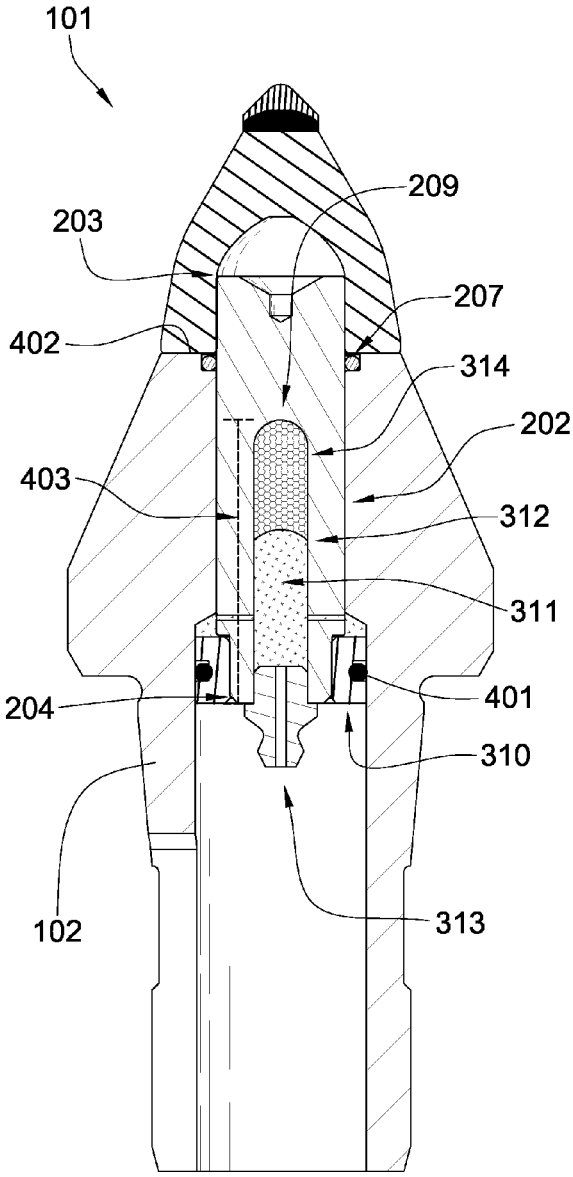
FIG. 4 is a cross-sectional diagram of another embodiment of a high-impact resistant pick.

Referring now to FIG. 4 another embodiment of a pick 101 is disclosed in a holder 102. The pick 101 comprises an embodiment of a ring 310 comprising an o-ring seal 401. The o-ring seal 401 may be a second seal 211. An o-ring 207, which may be a first seal 210, is disposed proximate a distal surface 402 of the holder 102 and substantially retains the lubricant 311 in the holder 102 between the pick 101 and the holder 102. In some embodiments of the invention the o-ring 207 proximate the distal surface 402 may form a weeping seal. FIG. 4 also discloses the hollow portion 209 of the shank 202 comprising a length 403. In some embodiments the length 403 may be at least as great as the outer diameter 305. At least part of the volume of the hollow portion 209 along length 403 is filled by the lubricant reservoir 312. In addition, the pressurization mechanism 314 is disposed in the hollow portion 209. In the present embodiment the pressurization mechanism comprises closed-cell foam. The hollow portion 209 of the shank 202 in FIG. 4 comprises an opening disposed in the second end 204. In the present embodiment this opening is sealed by a filling port 313.

Figure 5:
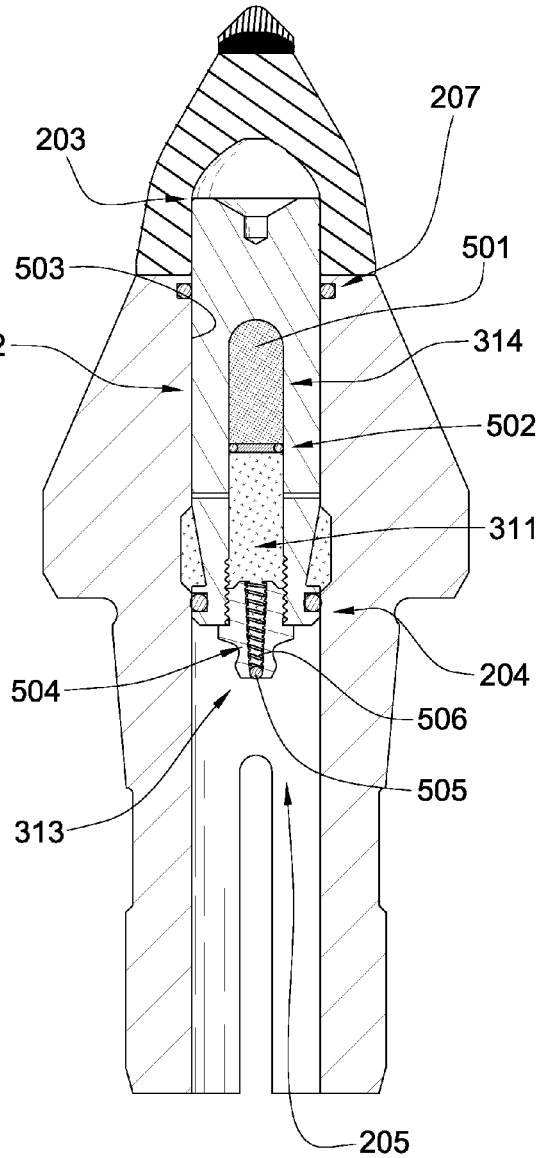
FIG. 5 is a cross-sectional diagram of another embodiment of a high-impact resistant pick.

FIG. 5 discloses a pick shank 202 comprising a tapered geometry proximate the second end 204. In addition, the pressurization mechanism 314 disposed in the lubricant reservoir of FIG. 5 comprises a pressurization gas 501 and a reservoir seal 502. Although in the present embodiment the pressurization mechanism 314 comprises a compressed gas 502, in some embodiments the pressurization mechanism 314 may comprise both a compressed gas 501 and either closed- or open-cell foam. FIG. 5 also discloses an o-ring 207 disposed intermediate the shank 202 and an inner surface 503 of the central bore 205. In FIG. 3 through 5, each of the pressurization mechanisms 314 may exert a force on the lubricant 311, where the force of the pressurization mechanism 314 is directed toward the second end 204 of the shank 202. In some embodiments of the invention, the force of the pressurization mechanism 314 may be directed toward the first end 203 of the shank 202. FIG. 5 also discloses an embodiment of a filling port 313 that comprises a one-way check valve 504. The check valve 504 in FIG. 5 comprises a ball 505 and a spring 506. When lubricant 311 is forced into the filling port 313 the ball 505 and the spring 506 may retract and allow the lubricant 311 to enter the port 313 and the lubricant reservoir 312. When lubricant 311 is no longer forced into the filling port 313 the spring 506 may extend the ball 505 and prevent the lubricant 311 from exiting the reservoir 312 through the second end 204 of the shank 202.

Figure 6:
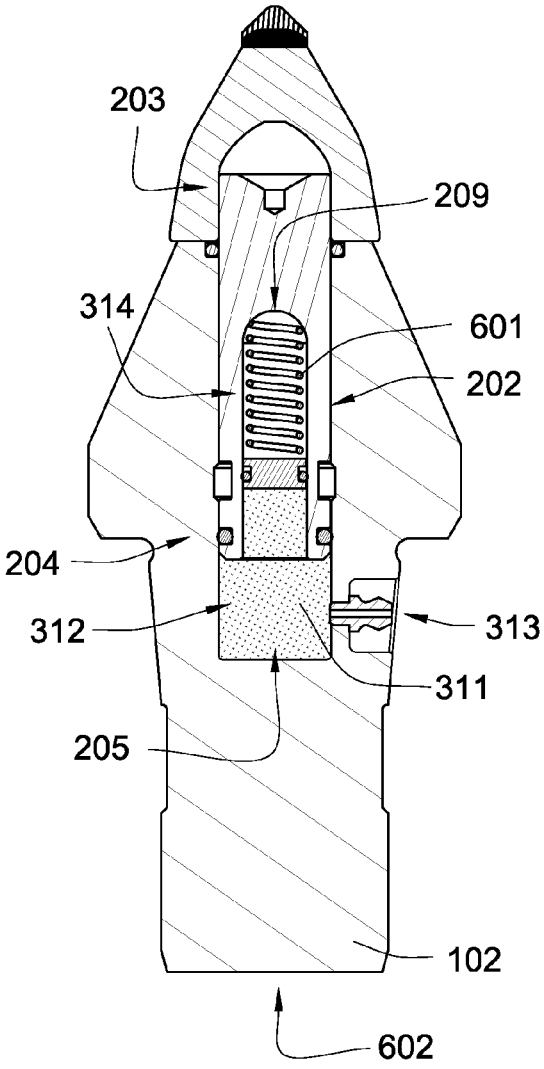
FIG. 6 is a cross-sectional diagram of another embodiment of a high-impact resistant pick.
Figure 7:
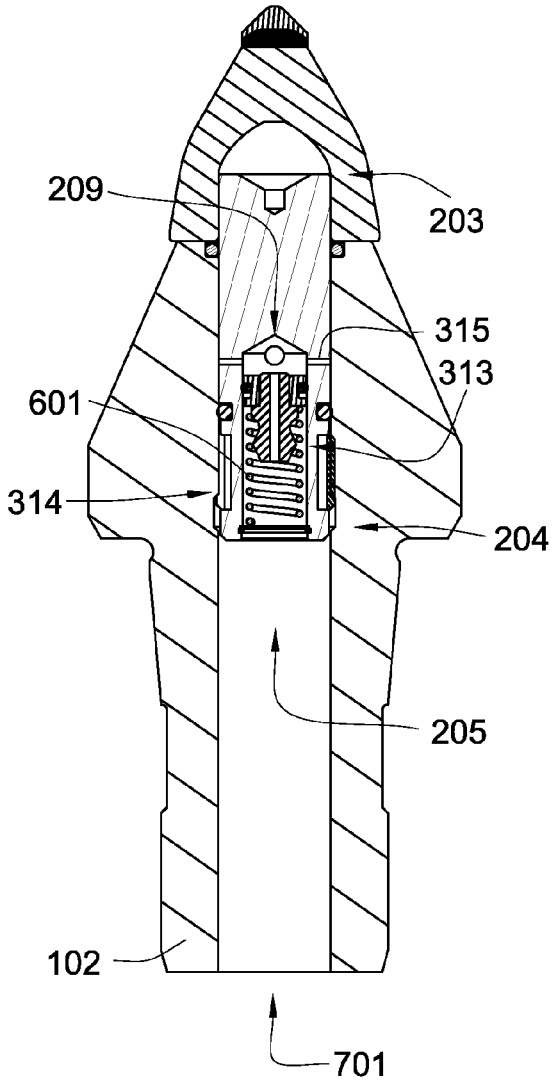
FIG. 7 is a cross-sectional diagram of another embodiment of a high-impact resistant pick.

Referring now to FIGS. 6 and 7, the pressurization mechanism 314 is a coiled spring 601. In FIG. 6 the coiled spring 601 the force of the pressurization mechanism 314 is directed toward the second end 204 and the mechanism 314 compresses the lubricant 311 toward the second end 204. In FIG. 7 the coiled spring 601 compresses the lubricant 311 toward the first end 203. In FIG. 7 the lubricant passes through exit pathways 315. In the embodiment of FIG. 6 the lubricant reservoir 312 is disposed partially within the hollow portion 209 of the shank 202 and partially within the central bore 205 of the holder 102. The filling port 313 in FIG. 6 is disposed proximate the pick shank 202 and the holder 102 comprises a closed end 602 proximate the driving mechanism 103. In FIG. 7 the filling port 313 may be accessed via an opening 701 of the central bore 205. Such a feature may be advantageous to decrease wear on the filling port 313, especially in applications where easy access to the central bore 205 of the holder 102 is available.

Figure 8:
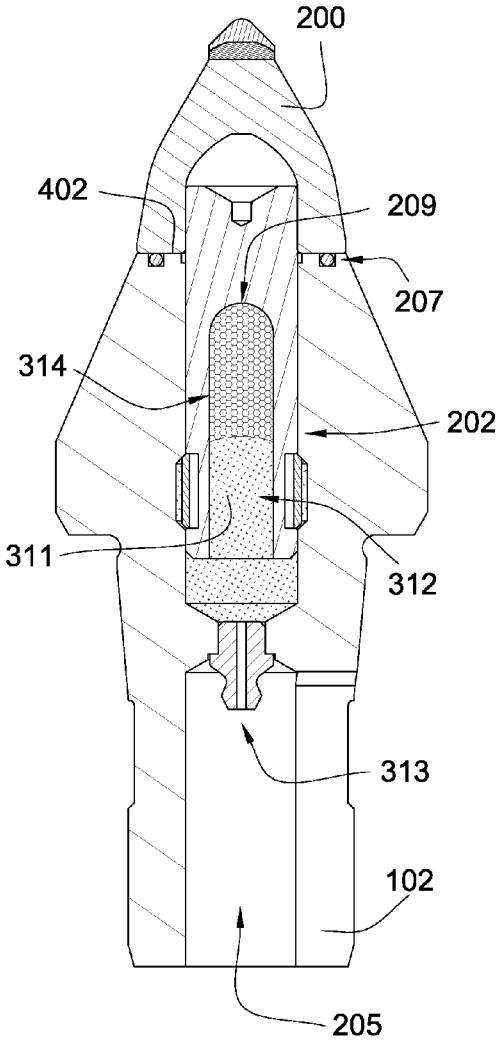
FIG. 8 is a cross-sectional diagram of another embodiment of a high-impact resistant pick.
Figure 9:
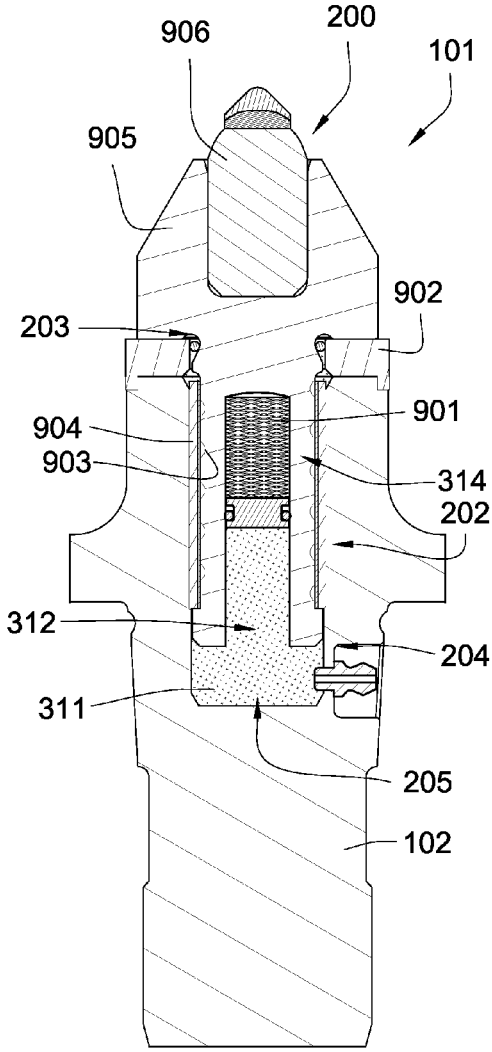
FIG. 9 is a cross-sectional diagram of another embodiment of a high-impact resistant pick.

FIGS. 8 and 9 disclose embodiments where the lubricant reservoir 312 is disposed both within the hollow portion 209 of the shank 202 and within at least part of the central bore 205 of the holder 102. In FIG. 8 the pressurization mechanism 314 comprises closed cell foam. In FIG. 9 the pressurization mechanism 314 comprises at least one wave spring 901. FIG. 8 also discloses an embodiment in which an o-ring 207 is disposed intermediate the bolster 200 and the distal surface 402. This embodiment may allow lubricant 311 to lower the friction between the bolster 200 and the holder 102 as the bolster 200 rotates with respect to the holder 102.

FIG. 9 discloses a washer 902 that may be radially disposed around the shank 202. The washer 902 intermediate the pick 101 and the holder 102 may decrease the wear of the pick 101. The washer 902 may be in contact with the holder 102 and may be fixed to the holder 102. In some embodiments rotation may occur between the washer 902 and the pick 101 during the milling process. The shank 202 or central bore 205 of the holder 102 may comprise grooves 903, which may provide a lubrication path for the lubricant 311. In FIG. 9 the grooves 903 are shown on the shank 202 and a bushing 904 is shown intermediate the shank 202 and the holder 102. FIG. 9 also discloses an embodiment in which a steel body 905 is disposed intermediate the bolster 200 and the first end 203 of the shank 202. In FIG. 9 the bolster 200 is a carbide core 906 that is press fit into the steel body 905. In some embodiments the core 906 may be brazed to the body 905.

Figure 10:
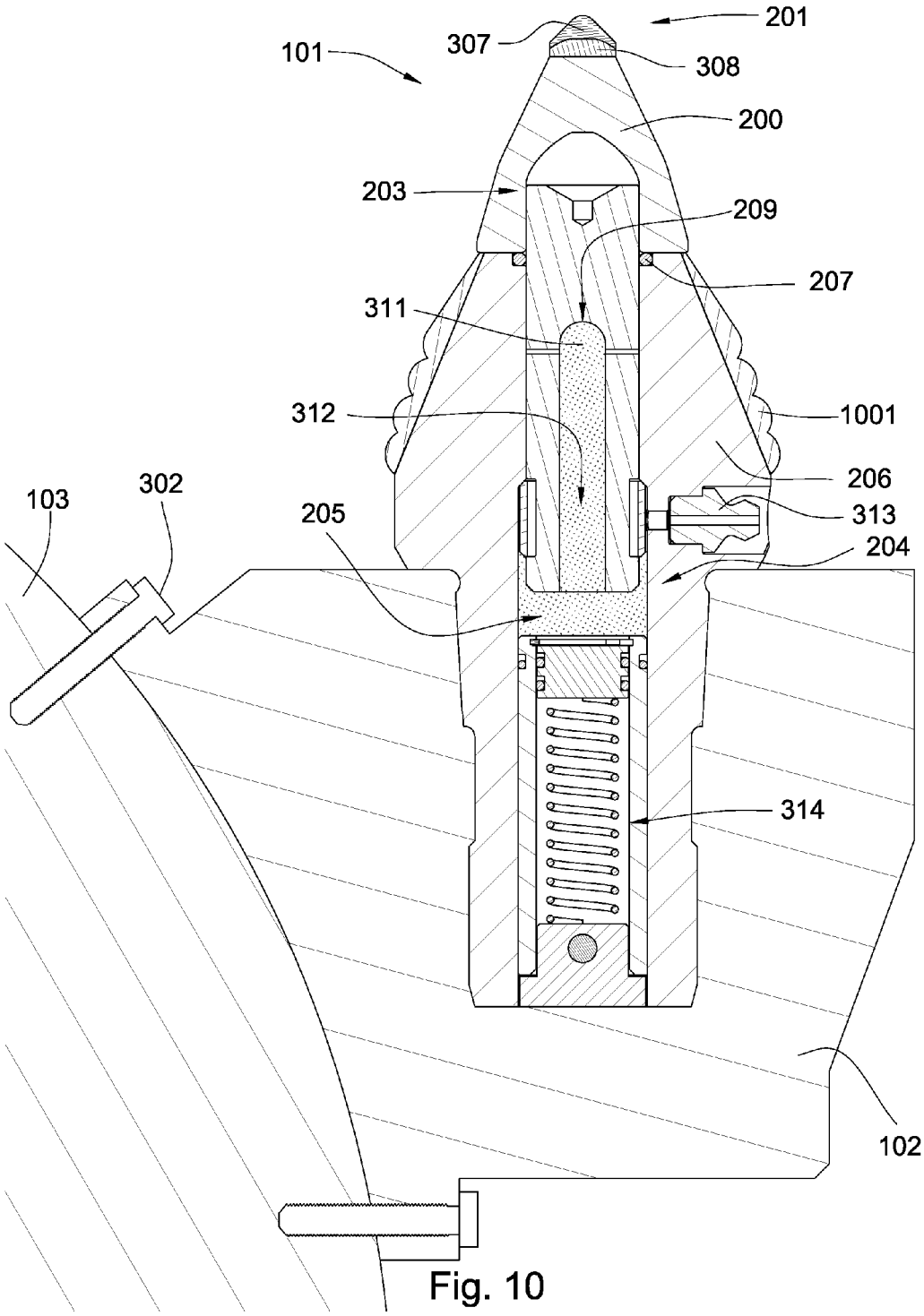
FIG. 10 is a cross-sectional diagram of another embodiment of a high-impact resistant pick.

FIG. 10 discloses the placement of a hard material 1001 on an exposed surface of an extension 206. Hard material 1001 may be disposed on other types of holders 102. Hard material may comprise at least one material selected from the group consisting of cobalt-base alloys, copper-base alloys, iron chromium alloys, manganese steel, nickel-base alloys, tool steel, tungsten carbide, and combinations thereof. Hard material 1001 may be applied to a surface by arc welding, torch welding, or by some other means. FIG. 10 also discloses an embodiment in which the pressurization mechanism 314 is disposed within the central bore 205 of the holder 102. In FIG. 10 part of the lubricant reservoir 312 is disposed within the hollow portion 209 of the shank 202, and the reservoir 312 extends into the central bore 205 of the holder 102.

Figure 11:
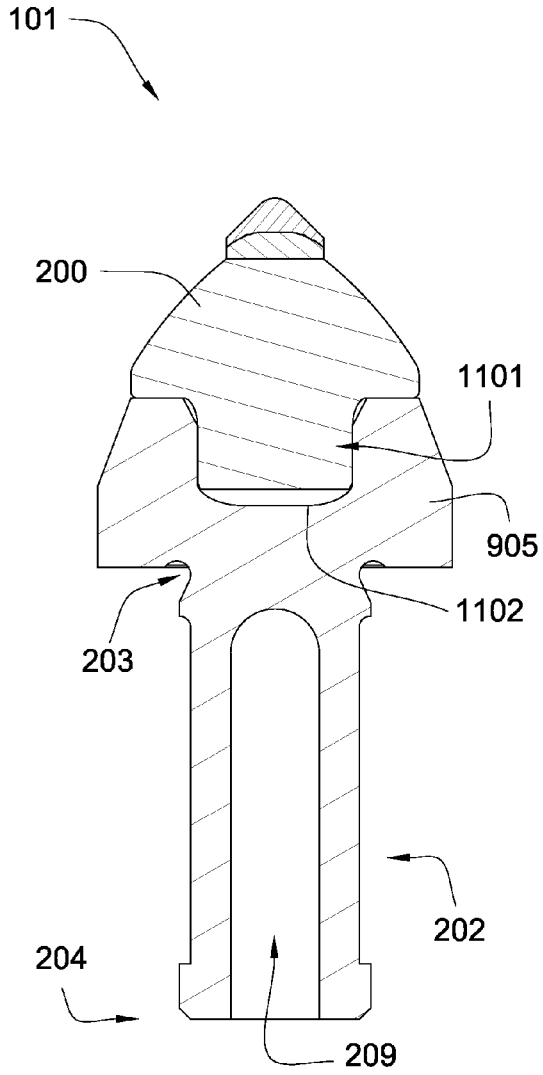
FIG. 11 is a cross-sectional diagram of another embodiment of a high-impact resistant pick.
Figure 12:
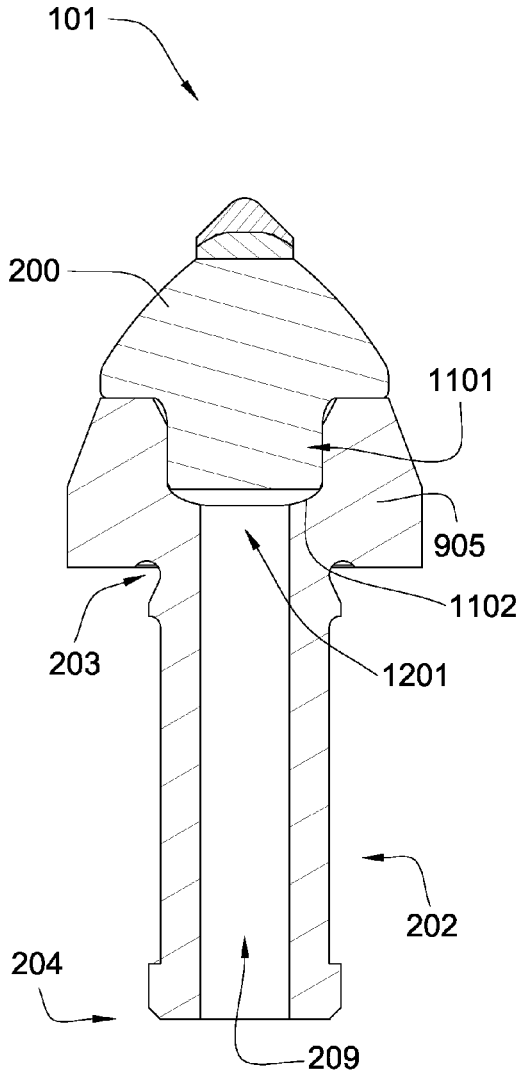
FIG. 12 is a cross-sectional diagram of another embodiment of a high-impact resistant pick.

FIGS. 11 and 12 disclose embodiments where a protrusion 1101 of the bolster 200 extends into a socket 1102 of the steel body 905. In some embodiments the protrusion 1101 may be press fit into the socket 1102. In FIG. 11 the hollow portion 209 of the shank 202 extends from the second end 204 but does not extend past the first end 203 of the shank 203. In FIG. 12 the hollow portion 209 of the shank connects to an aperture 1201 in the steel body 905. In the embodiment of FIG. 12, a lubricant reservoir 312 may be disposed within both the hollow portion 209 and the aperture 1201, and the lubricant reservoir 312 may extend from or before the second end 204 and past the first end 203.

Figure 13:
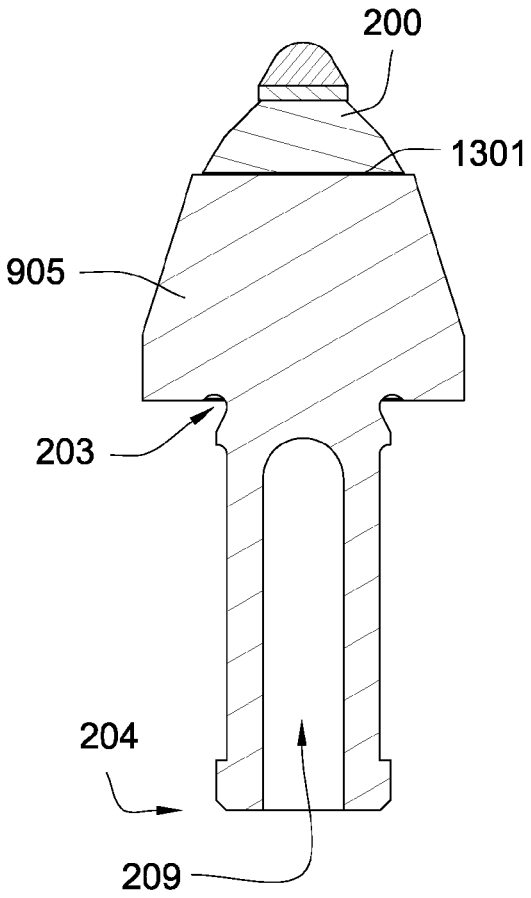
FIG. 13 is a cross-sectional diagram of another embodiment of a high-impact resistant pick.

FIG. 13 discloses an embodiment of the invention where the bolster 200 is brazed to the steel body 905 at a planar interface 1301. In the present embodiment the lubricant reservoir 312 may not extend past the first end 203 because the hollow portion 209 of the shank 202 does not extend past the first end 203. In other similar embodiments of the invention the hollow portion 209 of the shank 202 may extend past the first end 203 of the steel body 905, thereby allowing the lubricant reservoir 312 to extend past the first end 203 into the steel body 905.

Figure 14:
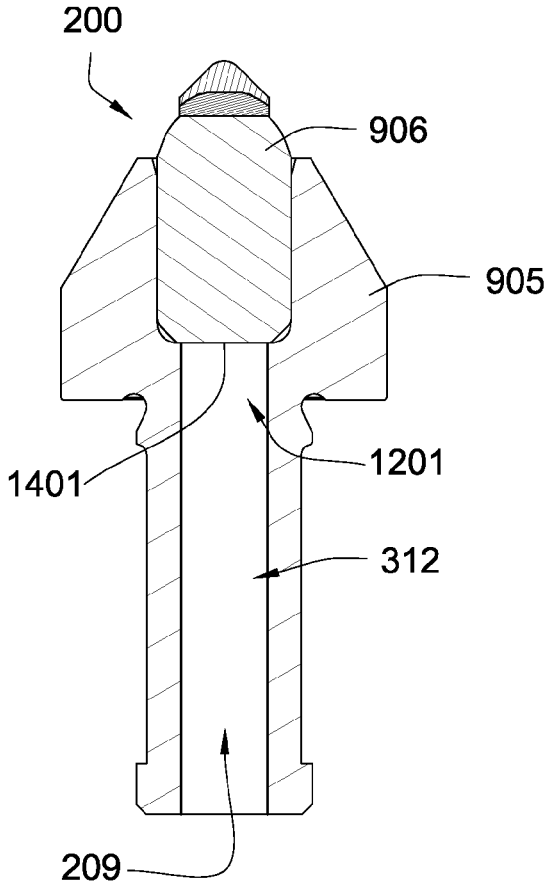
FIG. 14 is a cross-sectional diagram of another embodiment of a high-impact resistant pick.

FIG. 14 discloses an embodiment comprising a carbide core 906 wherein the lubricant reservoir 312 may extend through the hollow portion 209 of the shank 202, into an aperture 1201 in the steel body 905, and may stop at base 1401 of the carbide core 906.

Figure 15:
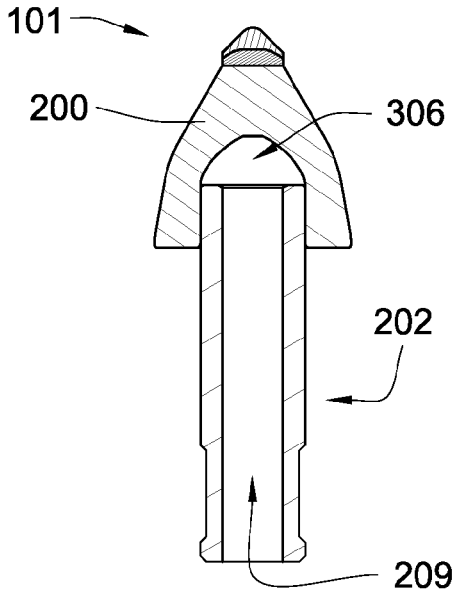
FIG. 15 is a cross-sectional diagram of another embodiment of a high-impact resistant pick.

FIG. 15 discloses a pick 101 wherein the hollow portion 209 of the shank 202 may fluidly connect to the recess 306 in the bolster 200. In some embodiments the lubricant reservoir 312 may be disposed in both the hollow portion 209 and the recess 306. The pick 101 may be used in a downhole rotary drill bit or in a horizontal directional drill bit. The pick 101 may be used in trenching machines, or in a mining machine for mining coal or other materials.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a holder attached to a driving mechanism and comprising a longitudinal central bore having an opening at a distal end firm the driving mechanism;

a pick comprising a bolster intermediate a shank and an impact tip;

the shank comprising an outer diameter and first and second ends, the second end being disposed in the central bore of the holder;

a first seal and a second seal being respectively disposed proximate the first and second ends of the shank; and an enclosed region disposed intermediate the first and second seals and disposed intermediate the pick and the holder; and wherein the enclosed region is in fluid communication with a pressurized lubricant reservoir wherein a lubricant from the reservoir enters an enclosed region through a passage opening disposed intermediate the first and second seals and the passage opening connects the enclosed region to a hollow portion of the shank.

2. The assembly of claim 1, wherein the lubricant reservoir comprises a lubricant selected from the group consisting of grease, petroleum products, vegetables oils, mineral oils, graphite, hydrogenated polyolefins, esters, silicone, fluorocarbons, molybdenum disulfide, and combinations thereof.

3. The assembly of claim 2, wherein the lubricant exerts a force on the pick that pulls a lower surface of the pick towards a distal surface of the holder.

4. The assembly of claim 1, wherein the lubricant enters the passage opening through a channel that leads from a filling port disposed outside the holder to the central bore of the holder.

5. The assembly of claim 1, wherein an inside surface of the bore of the holder comprises a tapered edge disposed proximate the second end of the shank.

6. The assembly of claim 5, wherein a ring is bonded to the second end of the shank proximate the tapered edge and the second seal.

7. The assembly of claim 6, wherein the ring and the tapered edge compress the second seal by at least 10%.

8. The assembly of claim 6, wherein the ring and the tapered edge compress the second seal by at least 15%.

9. The assembly of claim 6, wherein a pressurized lubricant maintains substantial contact between a lower surface of the pick and a distal surface of the holder by maintaining a substantially constant force on the ring.

10. The assembly of claim 1, wherein the impact tip comprises an impact surface with a hardness greater than 4000 HK.

11. The assembly of claim 1, wherein a steel body is disposed intermediate the first end and the bolster.

12. The assembly of claim 11, wherein the bolster is a carbide core that is press fit into the steel body.

13. The assembly of claim 11, wherein the steel body is brazed to the bolster.

14. The assembly of claim 1, wherein the bolster comprises a cemented metal carbide.

15. The assembly of claim 1, wherein the lubricant reservoir comprises a pressurization mechanism selected from the group consisting of springs, coiled springs, foam, closed-cell foam, compressed gas, wave springs, and combinations thereof.

16. The assembly of claim 1, wherein the outer diameter of the shank is between 0.5 and 2 inches.

17. The assembly of claim 1, wherein the enclosed region comprises an enclosed length that is at least one half a total length of the shank.

18. The assembly of claim 1, wherein the pick is part of an asphalt milling machine, a trenching machine, a coal mining machine, or combinations thereof.

* * * * *